US007472904B2

(12) United States Patent
Park

(10) Patent No.: US 7,472,904 B2
(45) Date of Patent: Jan. 6, 2009

(54) PAPER-FEEDING DEVICE OF IMAGE FORMING APPARATUS AND IMAGE FORMING APPARATUS USING THE SAME

(75) Inventor: Gyeong-ho Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 513 days.

(21) Appl. No.: 11/150,304

(22) Filed: Jun. 13, 2005

(65) Prior Publication Data

US 2006/0043664 A1 Mar. 2, 2006

(30) Foreign Application Priority Data

Aug. 28, 2004 (KR) ..... 10-2004-0068292

(51) Int. Cl.
*B65H 3/06* (2006.01)

(52) U.S. Cl. ..... 271/117; 271/162

(58) Field of Classification Search ..... 271/117, 271/162, 164
See application file for complete search history.

(56) References Cited

U.S. PATENT DOCUMENTS 3,306,491 A * 2/1967 Eisner et al. ..... 221/41
5,386,982 A 2/1995 Kawano
5,622,364 A * 4/1997 Dutton et al. ..... 271/117
5,932,313 A * 8/1999 Barton ..... 428/141
6,659,449 B2 * 12/2003 Kim ..... 271/117

FOREIGN PATENT DOCUMENTS

| | | |
|---|---|---|
| JP | 6-171771 | 6/1994 |
| JP | 9-40194 | 2/1997 |
| JP | 10-81422 | 3/1998 |
| KR | 2000-51619 | 8/2000 |
| KR | 2002-58321 | 7/2002 |
| KR | 2004-34255 | 4/2004 |

* cited by examiner

*Primary Examiner*—David H Bollinger
(74) *Attorney, Agent, or Firm*—Staas & Halsey LLP

(57) ABSTRACT

A paper-feeding device of an image forming apparatus and an image forming apparatus having the same include a paper-feeding cassette detachably mounted to a mounting section of a paper-feeding cassette in a body of the image forming apparatus, including a loading portion with plural sheets of paper and a front panel connected to the loading portion by a sliding member, a pick-up device provided at one side of the mounting section of the paper-feeding cassette, a pick-up bracket rotatably connected to a frame at an upper side of the mounting section and rotating around a rotating shaft, with one end of the pick-up bracket being connected to the pick-up device, and a pick-up controller operating in cooperation with the front panel when the paper-feeding cassette is mounted and removed to and from the mounting section, respectively.

16 Claims, 12 Drawing Sheets

PAPER-FEEDING DEVICE OF IMAGE FORMING APPARATUS AND IMAGE FORMING APPARATUS USING THE SAME

CROSS-REFERENCE TO RELATED APPLICATIONS

This application claims the priority of Korean Patent Application No. 10-2004-0068292, filed on Aug. 28, 2004, in the Korean Intellectual Property Office, the disclosure of which is incorporated herein in its entirety by reference.

BACKGROUND OF THE INVENTION

1. Field of the Invention

The present invention relates to an image forming apparatus, and more particularly, to a paper-feeding device capable of moving a pick-up device up and down in cooperation with a mounting/removing operation of a paper-feeding cassette of a dam division type in an image forming apparatus.

2. Description of the Related Art

Generally, image forming apparatuses, such as a printer, a copying machine, or a facsimile machine, sequentially pick-up and convey an uppermost paper sheet of a paper pile loaded in a paper-feeding cassette detachably mounted at a body of the image forming apparatus to an image forming section, thus forming an image.

FIG. 1 is a perspective view schematically showing a conventional image forming apparatus and a paper-feeding device thereof. FIG. 2 is a perspective view showing the conventional paper-feeding device in FIG. 1. FIG. 3 is a detailed plan view showing the pick-up device in FIG. 2.

With reference to FIG. 1, the conventional paper-feeding device includes a paper-feeding cassette 20 and a pick-up device 30. The paper-feeding cassette 20 loads plural sheets of paper. The pick-up device 30 is installed at an upper side of a paper-feeding cassette mounting section 10, and conveys the sheets of paper loaded in the paper-feeding cassette 20 to an image forming apparatus (not shown). The paper-feeding cassette mounting section 10 is provided at a body 1 of the image forming apparatus.

The pick-up device 30 includes a pick-up roller 31, an up-down section 32, and a driver 33. The pick-up roller 31 conveys the paper in a direction perpendicular to a removing direction of the paper-feeding cassette 20. The up-down section 32 drives in cooperation with a mounting and removing operation of the paper-feeding cassette 20, and moves the pick-up roller 31 up and down to the paper-feeding cassette 20. The driver 33 provides the rotational driving force to the pick-up roller 31 to sequentially convey the paper loaded in the paper-feeding cassette 20 in the base 5 of the body 1.

The pick-up roller 31 is installed to pick up the paper in a direction perpendicular to the removing direction of the paper-feeding cassette 20. As shown in FIG. 1, the paper-feeding cassette 20 is mounted and removed to and from a direction perpendicular to a pick-up and transferring direction of the paper for the body 1 of the image forming apparatus.

Referring to FIGS. 2 and 3, the up-down section 32 includes a cam projection 21, a support frame 35, a cam lever 40, a first rotating shaft 42, a locking arm 50, and a pick-up bracket 60. A curved cam portion of the cam projection 21 protrudes to one front end of the paper-feeding cassette 20. The support frame 35 is installed at the paper-feeding cassette mounting section 10 of the body 1. The cam lever 40 is installed at the support frame 35. Upon removing the paper-feeding cassette 20 from the paper-feeding cassette mounting section 10, the cam lever 40 rests on the cam projection 21 and is rotated by the cam projection 21. The first rotating shaft 42 is rotated in cooperation with the cam lever 40. The locking arm 50 is rotated in cooperation with, and in a direction opposite to a rotating direction of, the cam lever 40. The pick-up bracket 60 is rotatably connected to a third rotating shaft 61 installed at the support frame 35, and up and down movement of the pick-up bracket 60 is restricted by the locking arm 50.

As shown in FIGS. 2 and 3, the cam lever 40 is installed to be resiliently biased to the paper-feeding cassette 20 by the first coil spring 41, and is connected to the locking arm 50 through the first rotating shaft 42. The first coil spring 41 is installed at the body 1.

When the locking arm 50 rotates, a hook pin 51 provided to a free end of the locking arm 50 connects with the paper-feeding cassette 20 of the pick-up bracket 60 to restrict up and down movement of the paper-feeding cassette. Accordingly, the pick-up bracket 60 cooperates with the hook pin 51, and is moved up and down.

A free end portion of the pick-up bracket 60 rotatably supports the pick-up roller 31, and is installed to be resiliently biased to the paper-feeding cassette 20 by a second coil spring 62. The second coil spring 62 is installed at a support member 62*a* of the support frame 35. When the paper is conveyed, the pick-up roller 31 conveys the paper while pressing the uppermost sheet of paper loaded in the paper-feeding cassette 20 at a suitable pressure.

Furthermore, the pick-up bracket 60 includes a protrusion member 38 which protrudes downward from the pick-up bracket 60. The protrusion member 38 contacts a hook member 72 to be described below, thus restricting an operation of the pick-up bracket 60.

The driver 33 of the pick-up device 30 includes a driving motor 34 and a power transmission section (not shown). The driving motor 34 is installed at the support frame 35, and produces a rotational driving force. The power transmission section is installed inside the pick-up bracket 60, and provides the rotation rotating force of the driving motor 34 to the pick-up roller 31.

A locking/unlocking section 36 includes a solenoid driver 70, a third rotating shaft 71, and the hook member 72. The solenoid driver 70 is installed at the support frame 35. An operation of the solenoid driver 70 controls whether the solenoid driver 70 contacts with a connecting member 70*a* that is provided at one side of the paper-feeding cassette 20. The second rotating shaft 71 is installed at the support frame 35, and rotates by the operation of the solenoid driver 70. The hook member 72 is provided at one end of the second rotating shaft 71. As the second rotating shaft 71 rotates, the hook member 72 contacts and locks/unlocks the pick-up bracket 60.

That is, upon mounting the paper-feeding cassette 20 into the paper-feeding cassette mounting section 10, the cam projection 21 and the cam lever 40 contact each other. Further, the connecting member 70*a* provided at the one side of the paper-feeding cassette 20 comes in contact with the solenoid driver 70. At this time, the hook pin 51 is released due to the contact between the cam projection 21 and the cam lever 40, and the operation of the solenoid driver 70 rotates the second rotating shaft 71, and the pick-up bracket 60 is released, thus permitting the pick-up bracket 60 to be lowered.

When the paper-feeding cassette 20 is removed from the paper-feeding cassette mounting section 10, the cam projection 21 no longer is in contact with the cam lever 40, and the solenoid driver 70 no longer contacts the connecting member 70*a* provided at the one side of the paper-feeding cassette 20.

Consequently, the pick-up bracket 60 is raised according to a rotation of the hook pin 51 that is engaged with the cam lever 40. Furthermore, the hook member 72 constrains the protrusion member 38, immobilizing the pick-up bracket 60.

Hereinafter, an operation of the conventional paper-feeding device will be described.

As the paper-feeding cassette 20 in which paper is loaded is inserted into the paper-feeding cassette mounting section 10 of the body 1, the cam lever 40 contacts the cam projection 21 provided at the front end of the paper-feeding cassette 20, and is thus rotated upward. At the same time, the locking arm 50 is rotated downward.

Accordingly, the immobilized state of the pick-up bracket 60 due to the hook pin 51 provided at the free end of the locking arm 50 is released, whereas the immobilized state of the pick-up bracket 60 due to the hook member 72 is maintained. As a result, the pick-up bracket 60 is maintained in an initial state.

When the paper-feeding cassette 20 is further inserted into the paper-feeding cassette mounting section 10, the connecting member 70*a* provided at one side of the paper-feeding cassette 20, and the solenoid driver 70 contact each other. At this time, the solenoid driver 70 operates to rotate the rotating shaft 71, and the state of the pick-up bracket 60 immobilizing the protrusion member 38 is released. Accordingly, the pick-up bracket 60 descends by a self-weight, and contacts the uppermost sheet of paper loaded in the paper-feeding cassette 20.

At this time, as the pick-up bracket 60 is resiliently biased downward by a tensile force of the second coil spring 62 installed at a front end of the pick-up bracket 60, the pick-up roller 31 comes in contact with the uppermost sheet of paper loaded in the paper-feeding cassette 20, while pressing it at a suitable pressure.

In such a state, when a printing command is inputted to an image forming apparatus, a rotational driving force of the driving motor 34 is transferred to the pick-up roller 31. The pick-up roller 31 sequentially conveys the paper loaded in the paper-feeding cassette 20 by using the rotation driving force of the driving motor 34, so that a printing operation begins.

Through the above-mentioned operations, after the paper loaded in the paper-feeding cassette 20 has been used, to load a new paper pile therein, the paper-feeding cassette 20 is removed from the paper-feeding cassette mounting section 10. Upon removing the paper-feeding cassette 20 from the paper-feeding cassette mounting section 10, the interference between the cam projection 21 and the cam lever 40 is released, so that the cam lever 40 rotates downward by a restoring force of the first coil spring 41, and simultaneously the locking arm 50 rotates upward. Accordingly, the pick-up bracket 60 also ascends via the hook pin 51 that is provided at the free end of the locking arm 50. As the paper-feeding cassette 20 is removed from the paper-feeding cassette mounting section 10, the contact between the connecting member 70*a* provided at one side of the paper-feeding cassette 20 and the solenoid driver 70 is released. At that time, the solenoid driver 70 operates to rotate the second rotating shaft 71. The hook member 72 becomes engaged with the rotation of the second rotating shaft 71 and restricts a protrusion member 38 that is provided at the pick-up bracket 60.

According to the conventional image forming apparatus and the paper-feeding device as described above, in the case wherein upward and downward operation of the pick-up bracket 60 is restricted due to the hook member 72, in cooperation with the solenoid driver 70, upon mounting the paper-feeding cassette 20 in the paper-feeding cassette mounting section 10, the pick-up bracket 60 descends in a state in which the paper-feeding cassette 20 is not completely inserted into the paper-feeding cassette mounting section 10. Then, the pick-up roller 31 descends to pull and twist the uppermost sheet from the paper loaded in the paper-feeding cassette 20. When a printing process starts and the paper is picked-up, a paper skew or jam occurs. Furthermore, upon removing the paper-feeding cassette 20 from the paper-feeding cassette mounting section 10, the pick-up roller 31 ascends and may be caught on the paper-feeding cassette 20, resulting in a breakdown of a part of the pick-up roller 31.

SUMMARY OF THE INVENTION

Additional aspects and/or advantages of the invention will be set forth in part in the description which follows and, in part, will be obvious from the description, or may be learned by practice of the invention.

The present invention provides a paper-feeding device of an image forming apparatus, in which a pick-up roller moves downward after the paper-feeding device has been mounted in a body of the image forming apparatus in cooperation with a mounting operation of a paper-feeding cassette, and the paper-feeding cassette is removed from a mounting section after the pick-up roller is raised, and the present invention also includes an image forming apparatus having the paper-feeding device.

According to an aspect of the present invention, a paper-feeding device of an image forming apparatus includes a paper-feeding cassette detachably mounted to a mounting section of a paper-feeding cassette in a body of the image forming apparatus, and includes a loading portion with a plural sheets of paper and a front panel connected to the loading portion by a sliding member; a pick-up device provided at one side of the mounting section of the paper-feeding cassette to pick up the paper from the loading portion; a pick-up bracket rotatably connected to a frame that is provided at an upper side of the mounting section and rotates around a rotating shaft, with one end of the pick-up bracket being connected to the pick-up device; and a pick-up controller operating in cooperation with the front panel when the paper-feeding cassette is mounted and removed to and from the mounting section, respectively, wherein the pick-up controller lowers the pick-up device after the loading portion is completely mounted and detaches the loading portion after the pick-up device ascends.

The front panel may include a handling portion provided at a front portion of the front panel which is used when the paper-feeding cassette is mounted and removed; and a connecting member that slides toward the loading portion, and is connected to the handling portion so that the front panel is mounted and removed to and from the front portion of the loading portion in cooperation with the handling portion.

A complementary connecting portion may be provided at one side of the mounting portion of the paper-feeding cassette to be connected to the connecting member.

A connecting ring may be provided at the loading portion, and the connecting member may be connected and suspended from the connecting ring.

A resilient member may be provided at a circumference of the sliding member, and resiliently bias the front panel away from the loading portion in a connection releasing operation by the connecting member.

The pick-up controller may include a bearing portion formed at the other end of the pick-up bracket; a guide portion provided at the frame parallel with a direction of the rotating shaft to which the pick-up bracket is installed, wherein one end thereof contacts the front panel and reciprocates in the rotating shaft; and a cam portion provided at the other end of the guide portion to be connected to the bearing portion, and arranged to cause the pick-up bracket to perform a seesaw operation in cooperation with an operation of the front panel to raise and lower the pick-up device.

The guide portion may include a resilient member interfering with the frame when the guide portion contacts the front panel, and resiliently biases the guide portion in a direction of the front panel when the contact of the guide portion therewith is released.

According to another aspect of the present invention, an image forming apparatus has a paper-feeding device, and the paper-feeding device includes a paper-feeding cassette detachably mounted to a mounting section of a paper-feeding cassette in a body of the image forming apparatus, and includes a loading portion with plural sheets of paper and a front panel connected to the loading portion by a sliding member; a pick-up device provided at one side of the mounting section of the paper-feeding cassette to pick up the paper from the loading portion; a pick-up bracket rotatably connected to a frame that is provided at an upper side of the mounting section and rotates around a rotating shaft, with one end of the pick-up bracket being connected to the pick-up device; and a pick-up controller operating in cooperation with the front panel when the paper-feeding cassette is mounted and removed to and from the mounting section, respectively, wherein the pick-up controller lowers the pick-up device after the loading portion is completely mounted and detaches the loading portion after the pick-up device is raised.

The front panel may include a handling portion provided at a front portion of the front panel which is used when the paper-feeding cassette is mounted and removed; and a connecting member sliding that slides toward the loading portion, and is connected to the handling portion so that the front panel is mounted and removed to and from the front portion of the loading portion in cooperation with the handling portion.

The pick-up controller may include a bearing portion formed at the other end of the pick-up bracket; a guide portion provided at the frame parallel with a direction of the rotating shaft to which the pick-up bracket is installed, having one end thereof interfering with the front panel, and reciprocating in the direction of the rotating shaft; and a cam portion provided at the other end of the guide portion to be connected to the bearing portion, and causing the pick-up bracket to perform a seesaw operation in cooperation with an operation of the front panel to raise and lower the pick-up device.

The guide portion may include a resilient portion interfering with the frame when the guide portion contacts the front panel, and resiliently biasing the guide portion in a direction of the front panel when the contact of the guide portion therewith is released.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
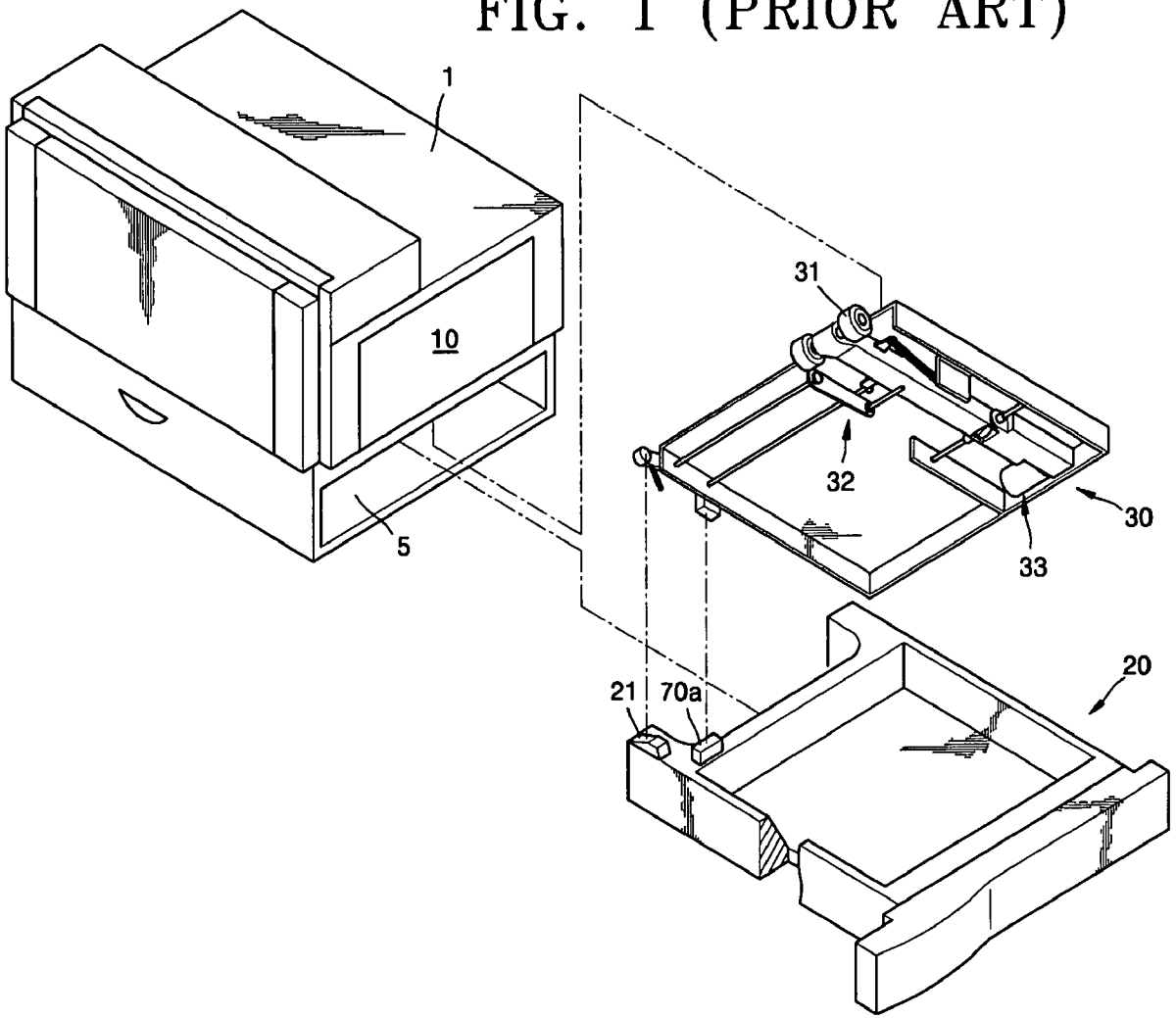
FIG. 1 (PRIOR ART)
FIG. 1 is a perspective view schematically showing a conventional image forming apparatus and a paper-feeding device thereof.
Figure 2:
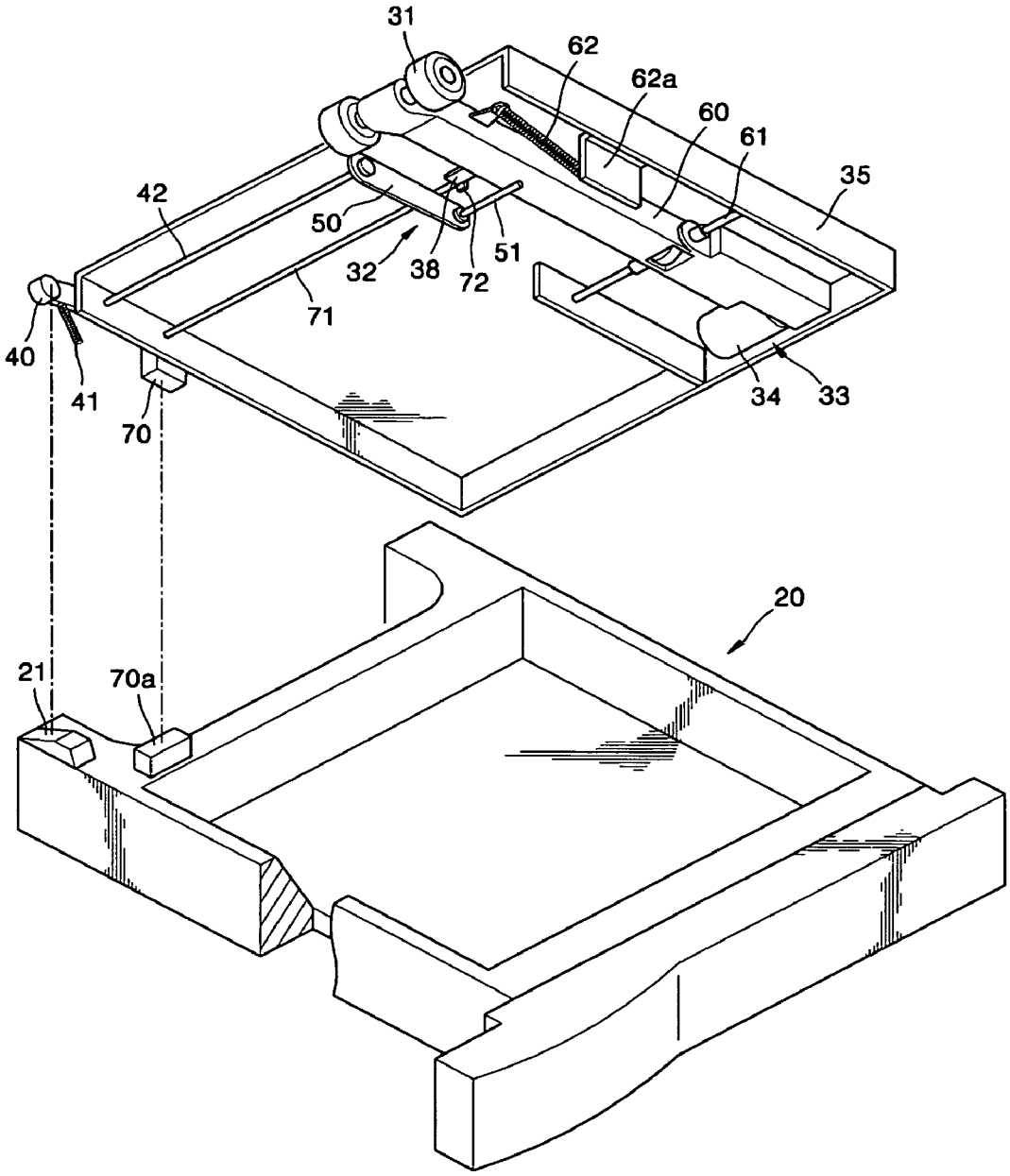
FIG. 2 (PRIOR ART)
FIG. 2 is a perspective view showing the conventional paper-feeding device in FIG. 1.
Figure 3:
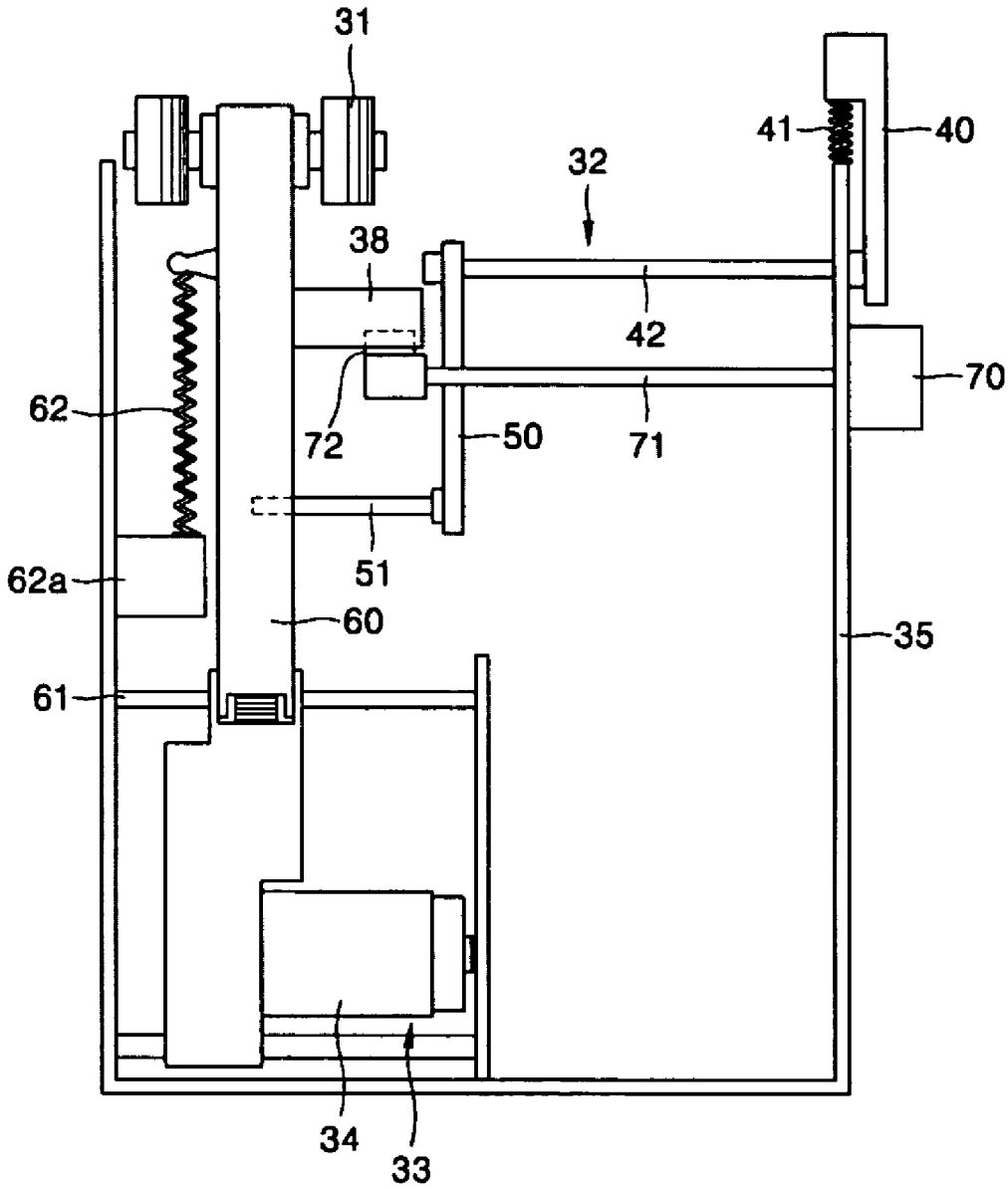
FIG. 3 (PRIOR ART)
FIG. 3 is a detailed plan view showing the pick-up device in FIG. 2.

Reference will now be made in detail to the embodiments of the present invention, examples of which are illustrated in the accompanying drawings. The embodiments are described below to explain the present invention by referring to the figures. This invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the thicknesses of layers and regions are exaggerated for clarity. Like numbers refer to like elements throughout the specification.

Figure 4:
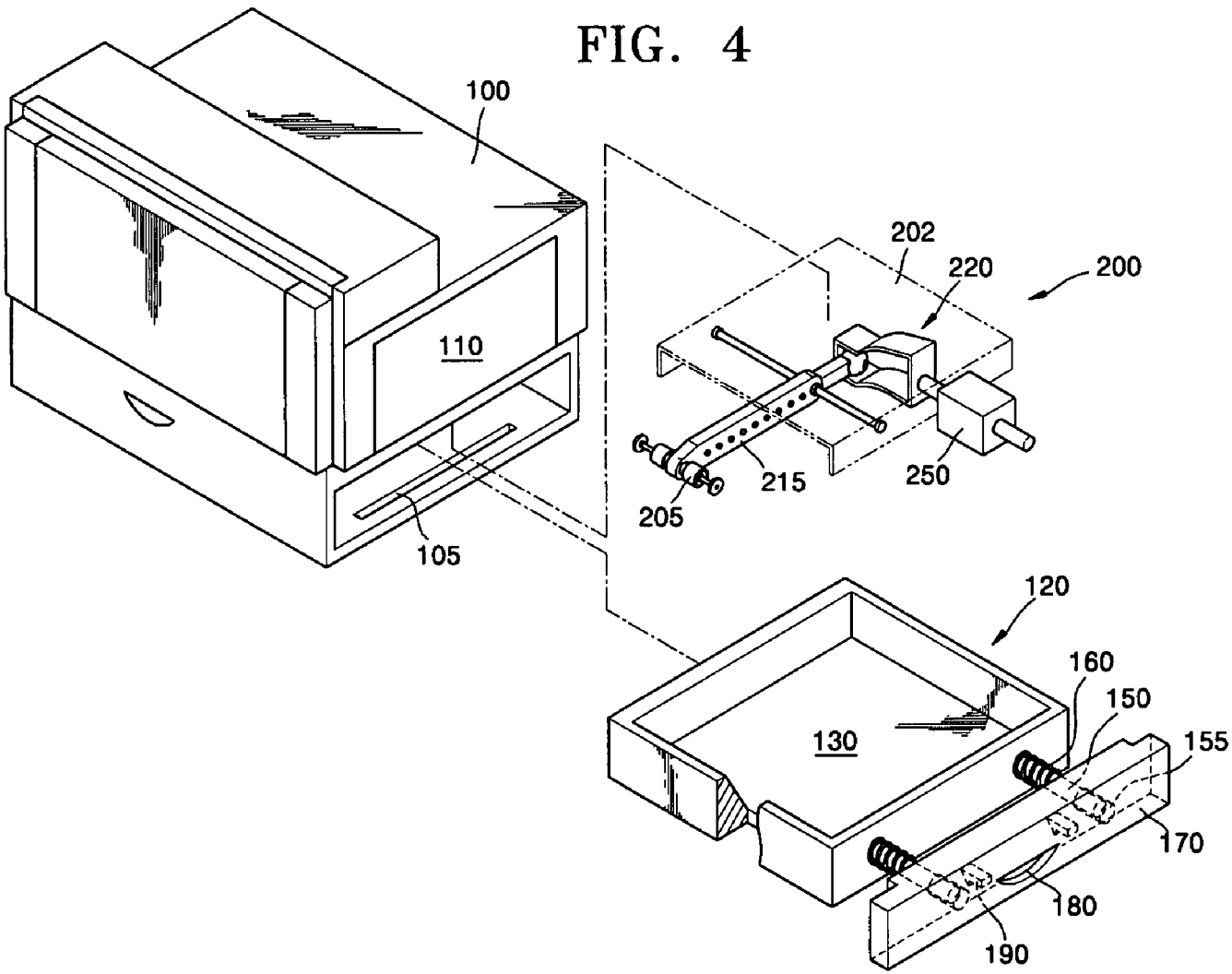
FIG. 4 is a perspective view schematically showing an image forming apparatus and a paper-feeding device thereof according to an embodiment of the present invention.

With reference to FIG. 4, the paper-feeding device thereof according to an embodiment of the present invention includes a paper-feeding cassette 120 and a pick-up device 200. The paper-feeding cassette 120 loads plural sheets of paper. The pick-up device 200 is installed at an upper side of a paper-feeding cassette mounting section 110 provided at a body 100 of the information forming apparatus, and transfers the paper loaded in the paper-feeding cassette 120 to an image forming section (not shown).

Figure 5A:
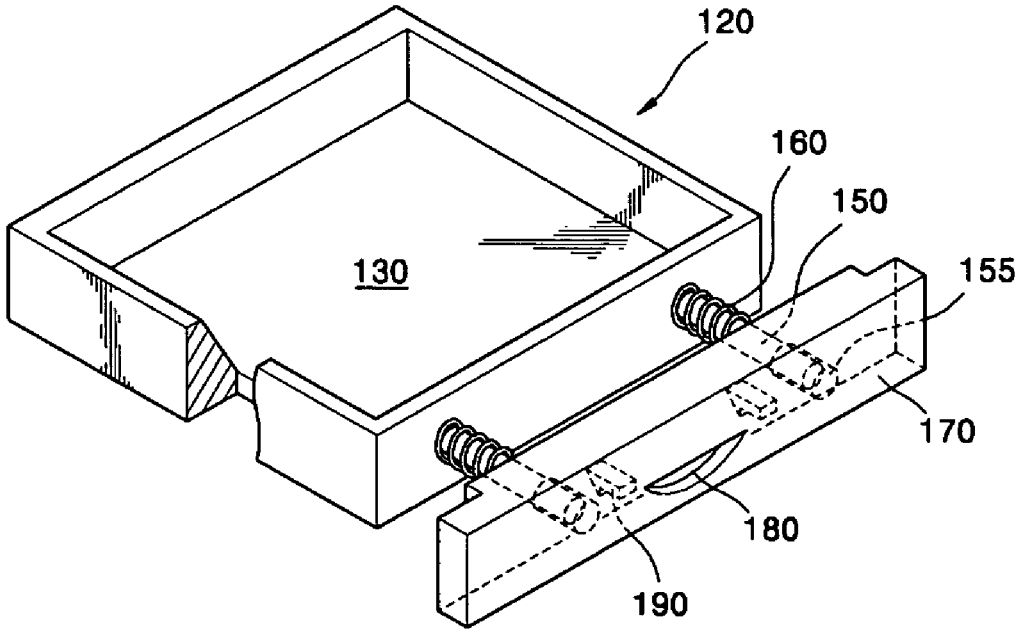
FIG. 5A is a perspective view showing one example of a paper-feeding cassette of the paper-feeding device in FIG. 4.
Figure 5B:
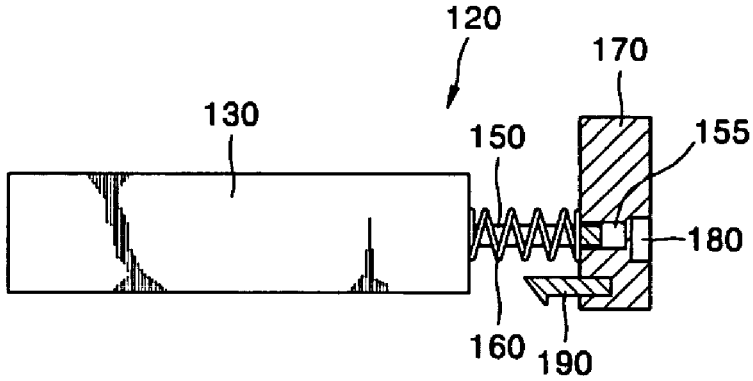
FIG. 5B is a cross-sectional view showing the paper-feeding cassette in FIG. 5A.

Referring to FIGS. 5A and 5B, the paper-feeding cassette 120 includes a loading portion 130 and a front panel 170. The loading portion 130 loads the paper. The front panel 170 is connected to the loading portion 130 through a sliding member 150 to slide close to, or be spaced apart from, the loading portion 130.

As shown in FIGS. 5A and 5B, after the loading portion 130 is completely mounted in the paper-feeding cassette mounting section 110, the front panel 170 is spaced from the loading portion 130 by a predetermined distance to reciprocate toward the loading portion 130. A handling portion 180 is provided at a front surface of the front panel 170 to be used during the mounting of the paper-feeding cassette. A connecting member 190 is provided at one side of the front panel 170, and is moved upward and downward in cooperation with the handling portion 180. After the front panel 170 slides toward the loading portion, it is detachably connected to a complementary connecting portion 155 of FIG. 4 or a connecting ring 165 of FIG. 7 through the connecting member 190.

The sliding member 150 is installed to allow the front panel 170 to reciprocate with the loading portion 130. Namely, the front panel 170 is installed to be connected to the loading portion 130, and slides thereto via the sliding member 150. A guide groove 155 is provided at the front panel 170 and the sliding member 150 is formed to slide in the sliding groove 155. Although the description has been given with respect to the case where the sliding groove 150 slides in the guide groove 155 provided at the front panel 170, it is not limited thereto. It will be apparent to those skilled in the art that various substitutions, modifications and changes may be made thereto without departing from the scope and spirit of the invention. For example, the sliding member 150 may be installed at a side surface or a lower side of the loading portion 130.

Preferably, a resilient member 160 is installed at a circumference of the sliding member 150. When the connection of the resilient member 160 is released by the connecting member 190, the resilient member 160 resiliently biases the front panel away from the loading portion by using a resiliently restoring force.

Figure 6:
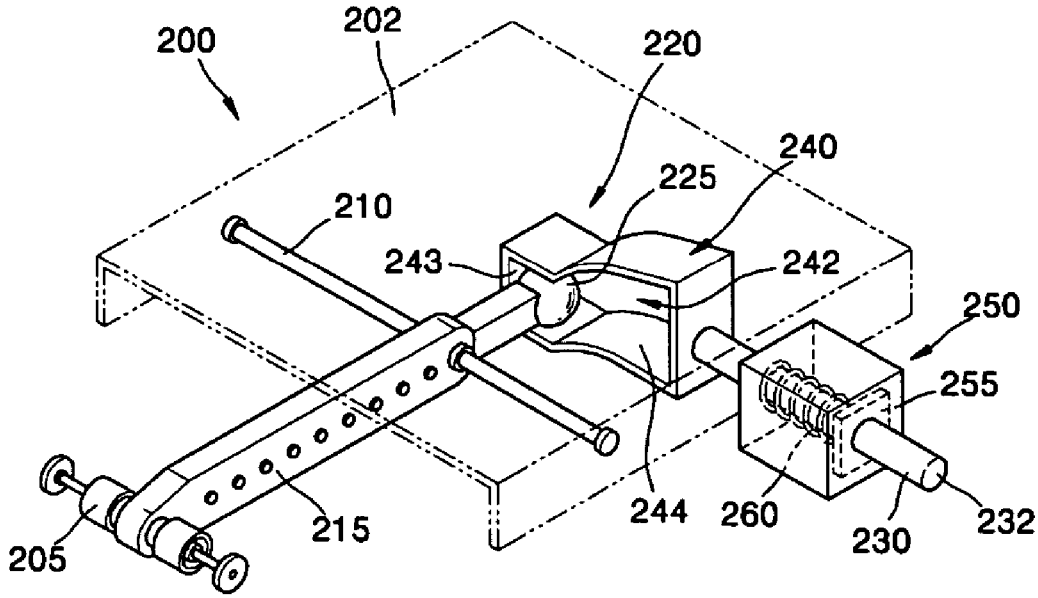
FIG. 6 is a perspective view showing the pick-up device of the paper-feeding device in FIG. 4.

Referring to FIG. 6, the pick-up device 200 includes a pick-up section 205, a frame 202, a pick-up bracket 215, and a pick-up controller 220. The pick-up section 205 conveys the paper in a direction perpendicular to a removing direction of the paper-feeding cassette 120. The frame 202 supports the pick-up section 205. The pick-up section 205 is connected to one end of the pick-up bracket 215. The pick-up controller 220 operates in cooperation with a mounting and removing operation of the paper-feed cassette 120.

The pick-up section 205 is installed at an upper side of the paper-feeding cassette mounting section 110 that allows the paper to be picked up in a direction perpendicular to a removing direction of the paper-feeding cassette 120. As shown in FIG. 4, the paper-feeding cassette 120 is mounted in, and removed to and from, a direction perpendicular to a pick-up and transferring direction of the paper for the body 100 of the image forming apparatus. The pick-up section 205 receives a rotational driving force from a driving source (not shown), and sequentially transfers the paper loaded in the loading portion 130.

The frame 202 is installed at an upper side of the paper-feeding cassette mounting section 110, and supports a rotating shaft 210 rotatably mounted at the pick-up bracket 215 and a guide portion 230.

The pick-up bracket 215 is rotatably installed at the rotating shaft 210 that is installed at the frame 202. The pick-up section 205 is connected to the pick-up bracket 215 and picks up the paper.

Upon removing the paper-feeding cassette 120 from the paper-feeding cassette mounting section 110, the pick-up controller 220 lowers the pick-up section 205 in cooperation with the front panel 170 after the mounting process of the loading portion 130 is completed. After the pick-up section 205 is raised, the pick-up controller 220 causes the loading portion 130 to be removed from the paper-feeding cassette mounting section 110. The pick-up controller 220 includes a bearing portion 225, a guide portion 230, a cam portion 240, and a resilient portion 250. The bearing portion 225 is formed at the other end of the pick-up bracket 205 to which the pick-up section 205 is connected.

The bearing portion 225 is raised and lowered in a direction opposite to ascending and descending direction of the pick-up section 205 based on the first rotating shaft 210 to which the pick-up bracket 215 is connected. That is, the bearing portion 225 is formed at an opposite side of the pick-up section 205 on the basis of the first rotating shaft 210 and rotates in cooperation with the pick-up section 205.

The guide portion 230 contacts the front panel 170 and reciprocates in a direction of the rotating shaft 210. The guide portion 230 is provided at the frame 202 parallel with the direction of the rotating shaft 210 to which the pick-up bracket 215 is installed. An interference portion 232 is provided at one end of the guide portion 230, contacts the front panel 170, and reciprocates in the direction of the rotating shaft 210.

The cam portion 240 is connected to the bearing portion 225. The resilient portion 250 is inserted into the frame 202, and provides a resilient restoring force to the guide portion 230. The cam portion 240 is provided at another end of the guide portion 230 to be connected to the bearing portion 225. The cam portion 240 causes the pick-up bracket 215 to perform a seesaw operation in cooperation with an operation of the front panel 170, thus raising and lowering the pick-up section 205. A bending portion 242 is vertically provided at the cam portion 204. The bearing portion 225 of the pick-up bracket 215 is connected to the bending portion 242 and operates in cooperation with a reciprocating motion of the guide portion 230. The bending portion 242 provided at the cam portion 240 includes a lower side 243 and an upper side 244. The bending portion 242 interferes with an operation of the bearing portion 225 to restrict raising and lowering operations of the pick-up section 205 that is installed at one end of the pick-up bracket 215. Accordingly, the pick-up section 205 is restricted and ascended/descended by a reciprocating motion of the cam portion 240 that is provided at the guide portion 230 in cooperation with the contact of the front panel 170. When the bearing portion 225 slides along the bending portion 242 and reaches the upper side 244 of the bending portion 242, the pick-up section 205 is lowered and contacts the paper. As the paper is picked-up and transferred from the upper side 244 of the bending portion 242, the bearing portion 225 is raised. Accordingly, it is preferable that the upper side 244 of the bending portion 242 is formed higher than the lower side of the bending portion 242.

The resilient portion 250 includes a support member 255 and a resilient member 260 therein. When the front panel 170 contacts the contact portion 232 of the guide portion 230, one side of the resilient portion 250 contacts the frame 202 and is compressed. The resilient member 260 resiliently biases the support member 255 to the front panel 170. When the contact of the guide portion 230 with the front panel 170 is released, the support member 225 pushes an inner wall of the resilient portion 250 to the front panel 170 by the restoring force of the resilient member 260. As a result, the guide portion 230 moves to the front panel 170 side.

A description will now be given, of an operation of the paper-feeding device according to an embodiment of the present invention.

Figure 8A:
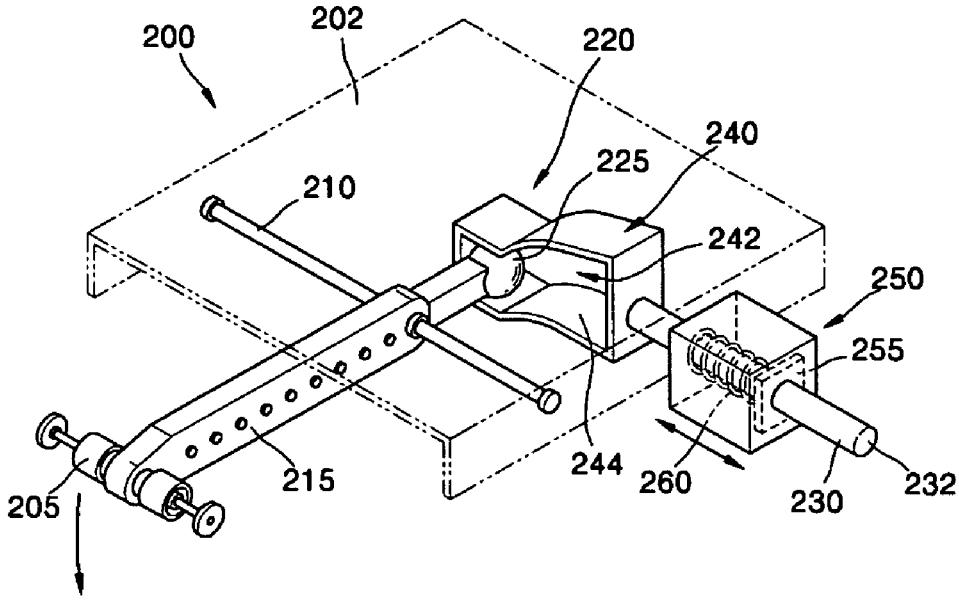
FIG. 8A is a perspective view of the pick-up device when the pick-up device in FIG. 6 ascends.
Figure 8B:
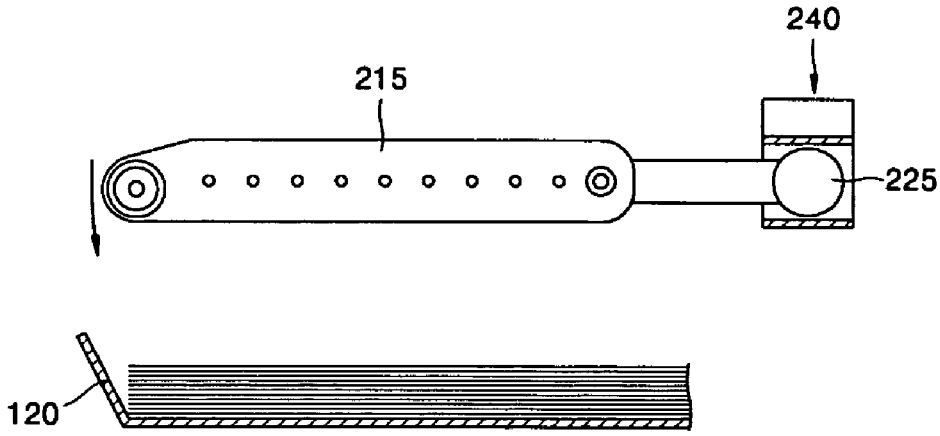
FIG. 8B is a side view of the pick-up device in FIG. 8A.
Figure 8C:
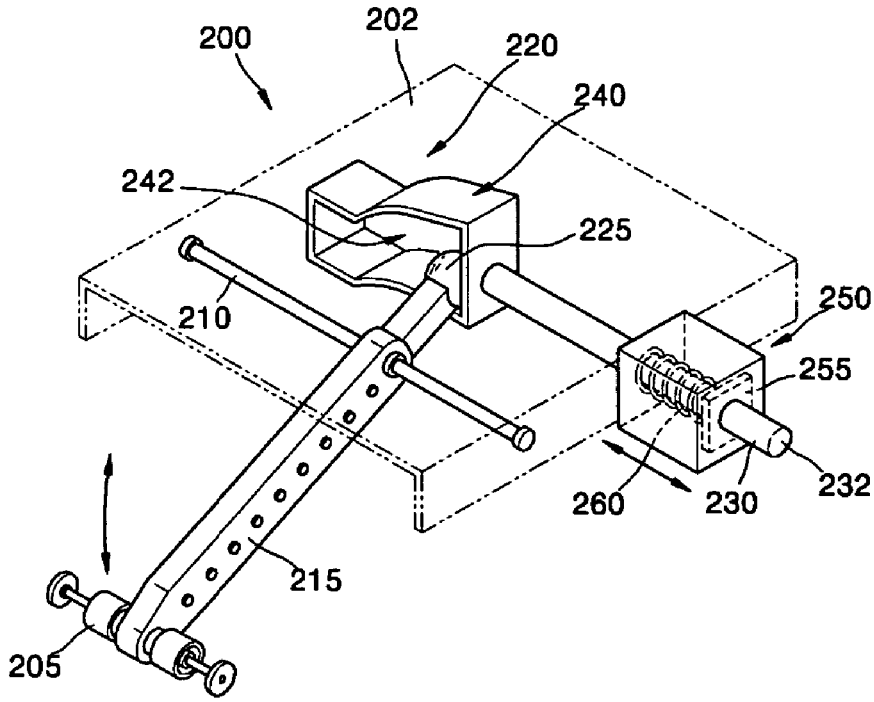
FIG. 8C is a perspective view of the pick-up device when the pick-up device in FIG. 6 descends.
Figure 8D:
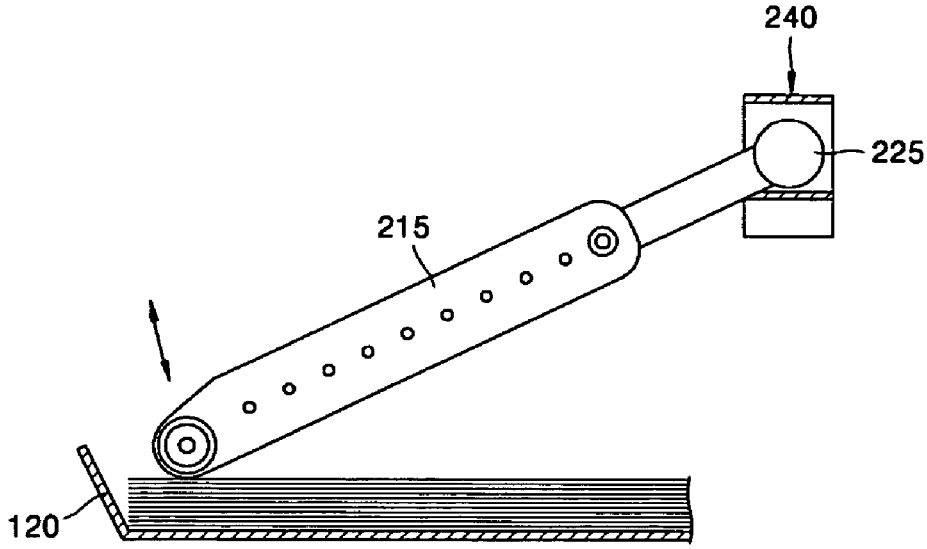
FIG. 8D is a side view of the pick-up device shown in FIG. 8C.
Figure 9A:
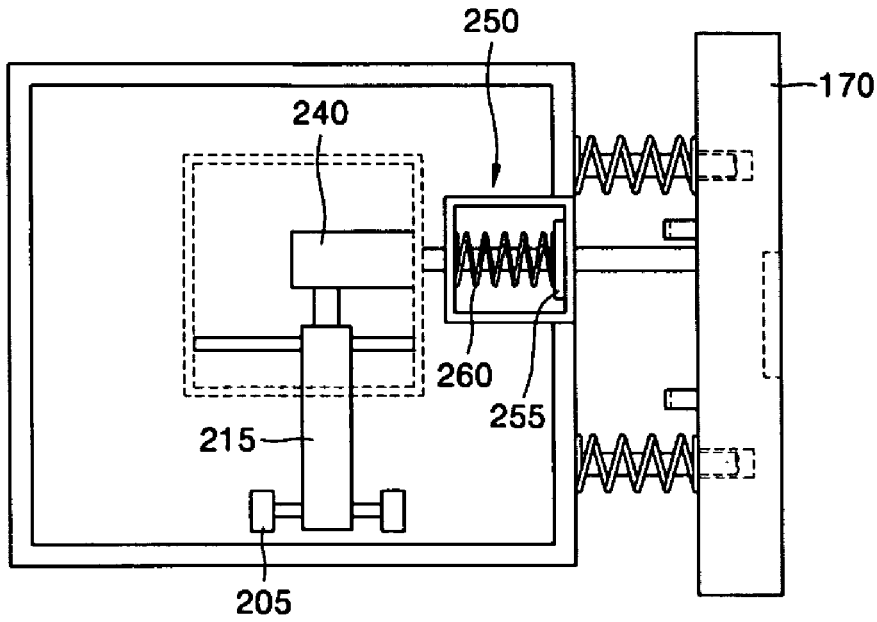
FIG. 9A is a view showing a paper-feeding cassette when a front panel is released from a loading portion.
Figure 9B:
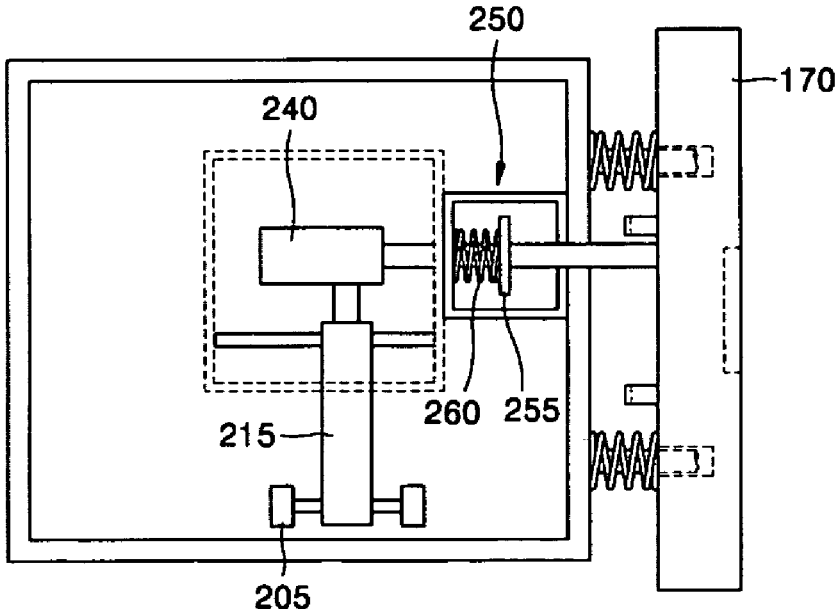
FIG. 9B is a view showing a paper-feeding cassette when a front panel is connected to a loading portion.
Figure 10:
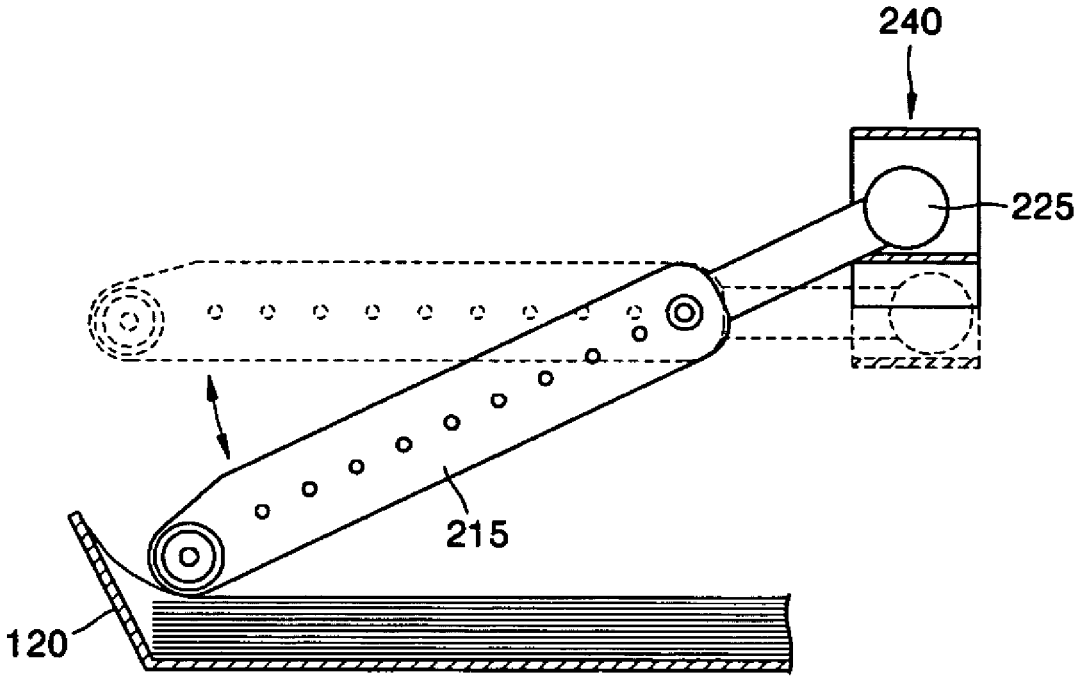
FIG. 10 is a side view illustrating raising and lowering operations of a pick-up device in accordance with an embodiment of the present invention.

FIGS. 8A through 8D show operation of the pick-up device, and FIGS. 9A and 9B show an operation of the front panel. FIG. 10 shows an operation of the pick-up device.

The loading portion 130 of the paper-feeding cassette 120 is inserted into the paper-feeding cassette mounting section 110 that is provided at the body 100 of the image forming apparatus. As is shown FIGS. 9A and 9B, the front panel 170 slides toward the loading portion 130, and is connected and fixed to the complementary connecting portion 105 of FIG. 4 or the connecting ring 165 of FIG. 7 through the connecting member 190. At that time, the sliding member 150 slides in the guide groove 155 formed at the front panel 170, and the resilient member 160 is pressed to resiliently bias the front panel 170 away from the loading portion 130.

The front panel 170 slides toward the loading portion 130 and contacts the contact portion 232 of the guide portion 230 supported by the frame 202. As the front panel 170 slides toward the loading portion 130, the guide portion 230 also slides in cooperation with an operation of the front panel 170. With reference to FIGS. 8A and 8B, as the guide portion 230 slides, the resilient portion 250 provided at the guide portion 230 contacts the frame 202, and is resiliently compressed into the frame 202. A cam portion 204 restricted by the operation of the guide portion 230 also slides and a bearing portion 225 slides from a lower side 243 to an upper side along a bending portion 242 that is formed at the cam portion 240. At the same time, the pick-up section 205 is lowered and contacts an uppermost sheet of paper loaded in the paper-feeding cassette 120 while pressing it.

In this state, when a printing command is provided to the image forming apparatus, a driving force of a driving source (not shown) is transferred to the pick-up section 205. The pick-up section 205 sequentially delivers the paper loaded in the loading portion 130 by the driving force, so that the printing operation begins.

Figure 7:
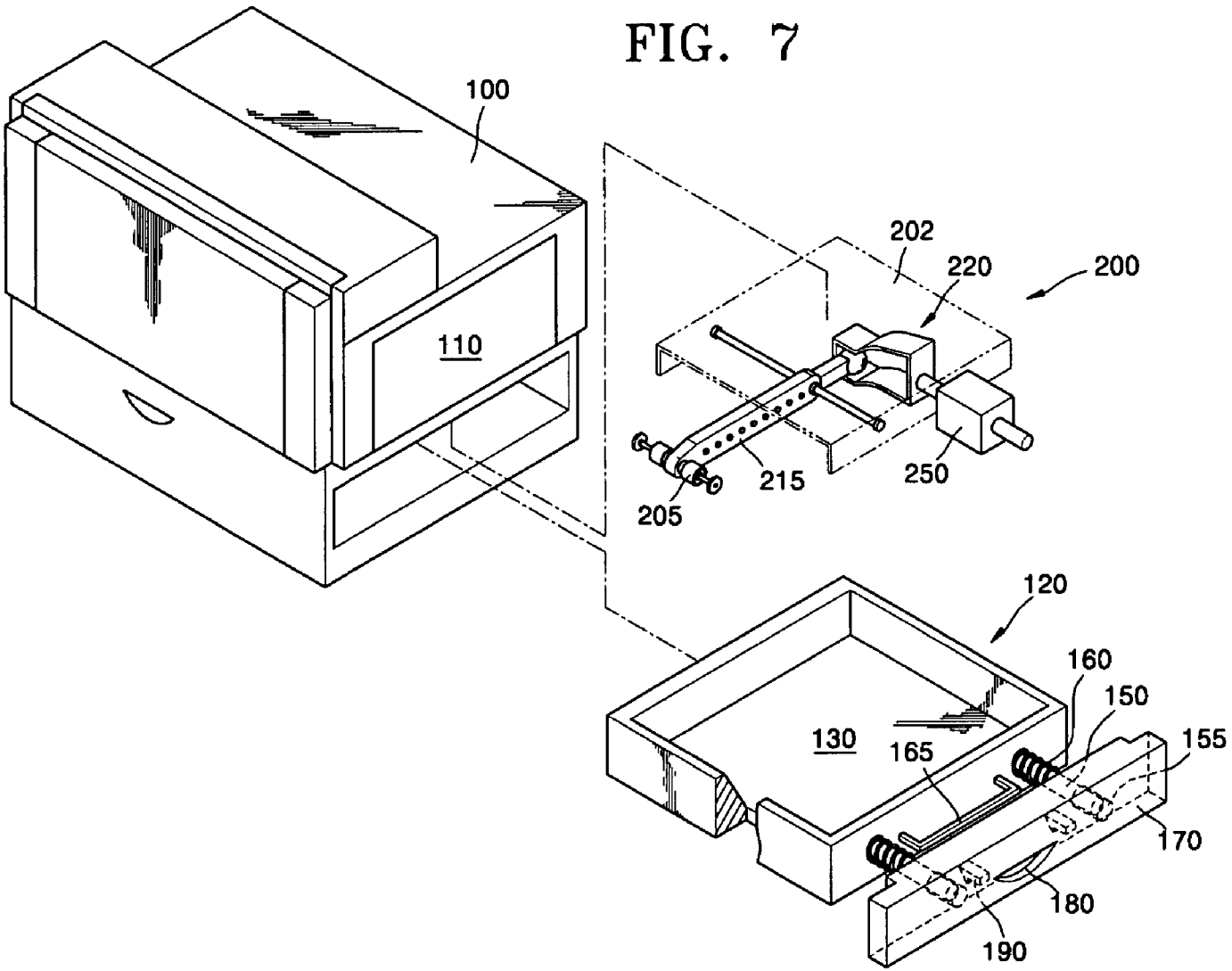
FIG. 7 is a perspective view showing another example of the paper-feeding cassette of the paper-feeding device in FIG. 4.

Through the above-mentioned operations, after the paper loaded in the paper-feeding cassette 120 is used, to load new paper therein, the paper-feeding cassette 120 is removed from the paper-feeding cassette mounting section 110. Upon removing the paper-feeding cassette 120 from the paper-feeding cassette mounting section 110, a connection of the connecting member 190 with the complementary connecting portion 105 of FIG. 4 or the connecting ring 165 of FIG. 7 is released. When the above-mentioned connection is released, the front panel 170 slides away from the loading portion 130 via the resilient member 160.

As the front panel 170 slides away from the loading portion 130, the guide portion 230 contacting the front panel 170 also slides toward the front panel 170 via the resiliently restoring force of a resilient portion that is resiliently compressed into a frame 202. Accordingly, the cam portion 240 restricted by the operation of the guide portion 230 slides, and the bearing portion 225 also slides from the upper side 244 to the lower side 243 along the bending portion 242 formed at the cam portion 240. At the same time, the pick-up section 205 is raised. After the raising of the pick-up section 205 is completed, the paper-feeding cassette 120 is removed from the paper-feeding cassette mounting section 110. Namely, as shown in FIG. 10, the movement of the pick-up section 205 is restricted by the cam portion 240 in cooperation with an operation of the front panel 170.

Figure 11:
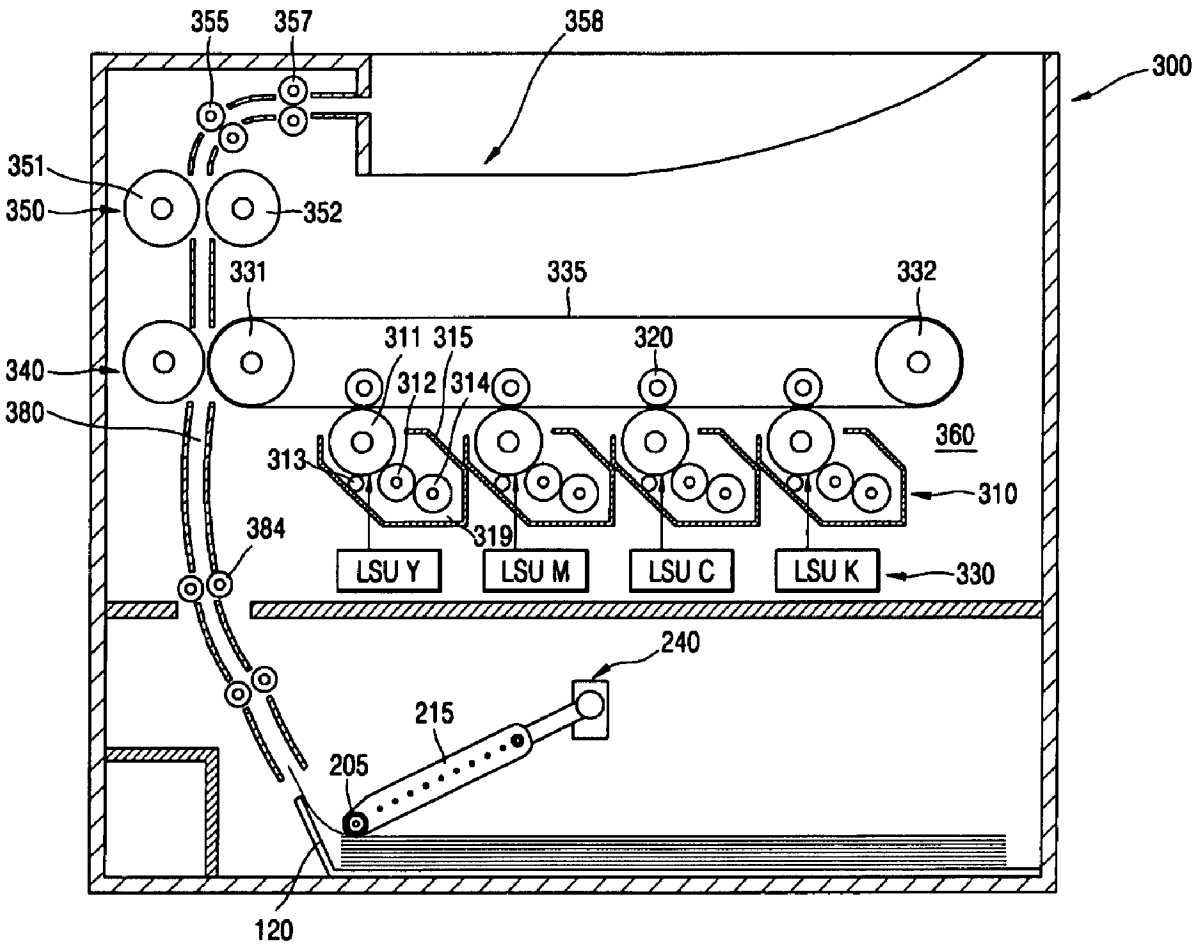
FIG. 11 is a cross-sectional view showing an image forming apparatus according to an embodiment of the present invention.

Hereinafter, an image forming apparatus 300 according to an embodiment of the present invention will be explained with reference to the accompanying drawings. FIG. 11 is a cross-sectional view showing the image forming apparatus.

Referring to FIG. 11, the image forming apparatus 300 according to the embodiment of the present invention includes an image forming section 360, a paper-feeding cassette 120, a pick-up device 200, and a conveyer 384. The image forming section 360 forms image information on a paper. The pick-up device 200 picks up a sheet of paper from the paper-feeding cassette 120. The conveyer 384 conveys the paper.

In an embodiment, the image forming section 360 includes four developing cartridges 310C, 310M, 310Y, and 310K, a first transfer section 320, exposing sections 330C, 330M, 330Y, and 330K, and an intermediate transfer belt 335. Toners of different colors, for example C (cyan), M (magenta), Y (yellow), and K (black), are received in the developing cartridges 310C, 310M, 310Y, and 310K, respectively.

The exposing sections 330C, 330M, 330Y, and 330K irradiate light corresponding to image information of C (cyan), M (magenta), Y (yellow), and K (black) on photosensitive drums 311 of developing cartridges 310C, 310M, 310Y, and 310K according to a computer signal, respectively. An embodiment of the present invention adopts a laser scanning unit (LSU) wherein the exposing sections 330C, 330M, 330Y, and 330K utilize a laser diode as a light source.

Each of the developing cartridges 310C, 310M, 310Y, and 310K includes a photosensitive drum 311, a developing roller 312, a charge roller 313, a supply roller 314, a storage section 319, a regulation member (not shown), and a cleaning member (not shown). The photosensitive drum 311 is installed, in which a part of a circumference thereof is exposed and rotates in a predetermined direction. The circumference of the photosensitive drum 311 is coated by a photoconductive material to form a photoconductive layer.

A charge bias voltage is applied to the charge roller 313 to charge the circumference of the photosensitive drum 311 with a constant electric potential. A corona charge device may be substituted for the charge roller 313.

A toner is adhered to the circumference of the developing roller 312 and a resulting developing roller 312 is supplied to the photosensitive drum 311. The developing roller 312 receives a toner of a solid powder. The toner of a solid powder is supplied to an electrostatic latent image to develop a toner image. A developing bias voltage is applied to the developing roller 312 to supply the toner to the photosensitive drum 311. The supply roller 314 and a toner layer regulation member (not shown) are installed at a housing 315 at an outer side of the developing roller 312. The supply roller 314 adheres the toner to the developing roller 312. The toner layer regulation member regulates an amount of the toner adhered to the developing roller 312.

Each of the developing cartridges 310C, 310M, 310Y, and 310K further includes an agitator to agitate the toner received therein.

The cleaning member is installed at the housing 315. One portion of the cleaning member contacts the photosensitive drum 311. The cleaning member comes in contact with the photosensitive drum 311 having a predetermined pressure to rake up the toner remaining in the photosensitive drum 311 after transfer. An edge of one side of the cleaning member may be installed at a support member (not shown) that is provided at the housing 315. An edge of the other side of the cleaning member contacts the photosensitive drum 311, and comes in contact with the photosensitive drum 311 having a predetermined pressure to scrape the toner remaining in the photosensitive drum 311 after transfer. A used toner storage section (not shown) is provided at an inside of each of the developing cartridges 310C, 310M, 310Y, and 310K and stores the toner removed from the photosensitive drum 311 by the cleaning member.

The developing cartridges 310C, 310M, 310Y, and 310K include openings that define paths wherein light scanned by the exposing sections 330C,330M, 330Y, and 330K are irradiated. An exposed circumference of the photosensitive drum 311 faces the intermediate transfer belt 335.

One surface of the intermediate transfer belt 335 is installed at the photosensitive drum 311, and the other surface thereof faces the first transfer section 320. The intermediate transfer belt 335 is supported by a plurality of support rollers 331 and 332 and cyclically travels through the photosensitive drum 311 and the first transfer section 320.

The first transfer section 320 is arranged in a location facing the photosensitive drum 311 in the intermediate transfer belt 335. In the embodiment, a transfer bias voltage having a polarity opposite to that of the toner image is applied to the first transfer section 320 so that a toner image developed in the photosensitive drum 311 is transferred to the paper. The toner image is delivered to the intermediate transfer belt 335 by an electrostatic force acting between the photosensitive drum 311 and the first transfer section 320.

A second transfer roller 340 is arranged in a location facing a support roller 331 with a transferring path that the paper passes. In the embodiment, a transfer bias voltage having a polarity opposite to that of the toner image is applied to the second transfer section 340 so that the toner image is first transferred to the intermediate transfer belt 335 and then is transferred to the paper. The toner image is delivered to the paper by an electrostatic force acting between the intermediate transfer belt 335 and the second transfer section 340.

A settling portion 350 includes a heat roller 351 and a pressure roller 352, and applies heat and pressurizes the toner image transferred to the paper that allows the toner image to be adhered to the paper. The heat roller 351 is a heat source to permanently adhere the toner image and is axially installed to face the pressure roller 352. The pressure roller 352 is installed to face the heat roller 351 and applies a high pressure to the paper that causes the toner image to be adhered to the paper.

A de-curl portion 355 passes the settling portion 350 to remove curl of the paper occurred by heat. A discharge roller 357 discharges the adhered paper outside the image forming apparatus. Paper discharged from the image forming section 360 to the discharge roller 357 along a paper transferring path is piled up at a paper discharge portion 358.

The paper-feeding cassette according to the embodiment of the present invention of FIG. 4 is used as the paper-feeding cassette 120. A construction and a function of the paper-feeding cassette 120 are identical to those of the paper-feeding cassette shown in FIG. 4.

The pick-up device 200 also adopts the pick-up device according to the embodiment of the present invention shown in FIG. 4. A construction and a function of the pick-up device 200 are identical with those of the pick-up device shown in FIG. 4. The pick-up device 200 is installed at an upper side of the paper-feeding cassette 120, and transfers a paper to the image forming section 360 side through a plurality of rollers (not shown). Subsequently, the paper is discharged outside the image forming apparatus by the discharge roller 357.

The paper transferred by the pick-up device 200 is delivered to the front of a nip of a second transfer section 340. The conveyer 384 is installed at the transferring path 380, and conveys the paper transferred from the pick-up device 200 to the image forming section 360.

Hereinafter, the operation of the image forming apparatus according to an embodiment of the present invention will be explained.

Each photosensitive drum 311 of developing cartridges 310C, 310M, 310Y, and 310K is charged at a constant electric potential by the charge bias voltage applied to the charge roller 313. The exposing sections 330C, 330M, 330Y, and 330K irradiate light corresponding to image information of C, M, Y, and K to the developing cartridges 310C, 310M, 310Y, and 310K through openings (not shown), respectively. When the light is irradiated, only irradiated parts are selectively charged to lower the electric potential. An output pattern formed by a potential difference is an electrostatic latent image.

On the other hand, a toner is supplied to a developing roller 312 to which a developing voltage is applied. The toner adhered to a circumference of the developing roller 312 becomes a thin film having a uniform thickness by a toner layer regulation member (not shown). The toner rubs against the developing roller 312 via the toner layer regulation member to be charged. The toner adhered to the circumference of the developing roller 312 adheres to the electrostatic latent image formed at the circumference of the photosensitive drum 311. Toner images of C, M, Y, and B colors are formed on the photosensitive drums 311 of the developing cartridges 310C, 310M, 310Y, and 310K.

The paper is withdrawn from the paper-feeding cassette 120 by the pick-up device 200, and is conveyed to the nip of the second transfer section 340 by the conveyer 384. At this time the paper is conveyed at the same velocity as that of a running line of the intermediate transfer belt 335. When a front end of the toner image is first transferred to the intermediated transfer belt 335 by the developing cartridges 310C, 310M, 310Y, and 310K reaches a transfer nip facing the second transfer section 340, a front end of the paper reaches a transfer nip.

As described above, when the paper passes between the second transfer section 340 to which the transfer bias voltage is applied and a transfer roller 331, the first transferred toner image to the intermediate transfer belt 335 is transferred to the paper.

After the transfer operation, a cleaning member (not shown) removes toner remaining on the circumference of the photosensitive drum. The settling portion 350 applies heat and pressure to a color toner image on the paper formed by the transfer operation that allows the toner image to be adhered to the paper. The de-curl portion 355 passes the settling portion 350 to remove the curl of the paper that is caused by heat. The paper from which curl is removed is discharged outside the apparatus by a discharge roller 357. Paper discharged from the discharge roller 357 is piled up at a paper discharge portion 358.

According to the construction as described above, unlike the conventional paper-feeding device and image forming apparatus, the pick-up device is lowered after the mounting of the loading portion is terminated, and then the paper-feeding cassette is removed from the mounting portion after the pick-up device is lowered.

As mentioned above, unlike the conventional paper-feeding device and image forming apparatus, in the paper-feeding device and the image forming apparatus having the paper-feeding device according to the present invention, since the pick-up device is lowered after a mounting of the loading portion, it prevents occurrence of paper skew or jam due to the pick-up device. Furthermore, since the paper-feeding cassette is removed from the mounting portion after raising the pick-up device, it prevents the pick-up device from being caught on the paper-feeding cassette resulting in a breakdown of the pick-up roller.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper-feeding device of an image forming apparatus, comprising:

a paper-feeding cassette detachably mounted to a mounting section of the paper-feeding cassette in a body of the image forming apparatus, and including a loading portion with plural sheets of paper and a front panel connected to the loading portion to slide close to/apart from the loading portion;

a pick-up device provided at one side of the mounting section of the paper-feeding cassette to pick up the paper from the loading portion; and a pick-up controller operating in cooperation with a sliding of the front panel with respect to the loading portion when the paper-feeding cassette is mounted and removed and the pick-up controller lowering the pick-up device after the loading portion is mounted to the mounting section and detaching the loading portion from the mounting section after the pick-up device is raised, wherein the front panel includes:

a handling portion provided at a front portion of the front panel and used when the paper-feeding cassette is mounted and removed; and a connecting member sliding toward the loading portion, and connected to the handling portion so that the front panel is mounted and removed to and from the front portion of the loading portion in cooperation with the handling portion, and wherein a connecting ring is provided at the loading portion, and the connecting member is connected and suspended from the connecting ring.

2. The paper-feeding device of claim 1, further including:

a pick-up bracket rotatably connected to a frame that is provided at an upper side of the mounting section and rotating around a rotating shaft, with one end of the pick-up bracket being connected to the pick-up device; and the front panel is connected to the loading portion by a sliding member, and the pickup controller operating in cooperation with the front panel and lowering the pick-up device after the loading portion is mounted and detaching the loading portion after the pick-up device is raised.

3. The paper-feeding device of claim 1, wherein a complementary connecting portion is provided at one side of the mounting section of the paper-feeding cassette to be connected to the connecting member.

4. The paper-feeding device of claim 3, wherein a resilient member is provided at a circumference of the sliding member, and resiliently biases the front panel away from the loading portion in a connection releasing operation by the connecting member.

5. The paper-feeding device of claim 4, wherein the pick-up controller includes:

a bearing portion formed at the other end of the pick-up bracket;

a guide portion provided at the frame parallel with a direction of the rotating shaft to which the pick-up bracket is installed, and having one end thereof contacting the front panel, and reciprocating in the direction of the rotating shaft; and a cam portion provided at the other end of the guide portion to be connected to the bearing portion, and causing the pick-up bracket to perform a seesaw operation in cooperation with an operation of the front panel to raise and lower the pick-up device.

6. The paper-feeding device of claim 5, wherein the guide portion includes a resilient portion interfering with the frame when the guide portion contacts the front panel, and resiliently biases the guide portion in a direction of the front panel when the contact of the guide portion therewith is released.

7. The paper-feeding device of claim 1, wherein a resilient member is provided at a circumference of the sliding member, and resiliently biases the front panel away from the loading portion in a connection releasing operation by the connecting member.

8. The paper-feeding device of claim 1, wherein a resilient member is provided at a circumference of the sliding member, and resiliently biases the front panel away from the loading portion at a connection releasing operation by the connecting member.

9. The paper-feeding device of claim 8, wherein the pick-up controller includes:

a bearing portion formed at the other end of the pick-up bracket;

a guide portion provided at the frame parallel with a direction of the rotating shaft to which the pick-up bracket is installed, and one end thereof contacting the front panel, and reciprocating in the rotating shaft; and a cam portion provided at the other end of the guide portion to be connected to the bearing portion, and causing the pick-up bracket to perform a seesaw operation in cooperation with an operation of the front panel to raise and lower the pick-up device.

10. The paper-feeding device of claim 9, wherein the guide portion includes a resilient portion contacting the frame when the guide portion contacts the front panel, and resiliently biasing the guide portion in a direction of the front panel when the contact of the guide portion therewith is released.

11. The paper-feeding device of claim 1, wherein the pick-up controller includes:

a bearing portion formed at the other end of the pick-up bracket;

a guide portion provided at the frame parallel with a direction of the rotating shaft to which the pick-up bracket is installed, and having one end thereof contacting the front panel, and reciprocating in a direction of the rotating shaft;

a cam portion provided at another end of the guide portion to be connected to the bearing portion, and causing the pick-up bracket to perform a seesaw operation in cooperation with an operation of the front panel to raise and lower the pick-up device, and the guide portion includes a resilient portion contacting the frame when the guide portion contacts the front panel, and resiliently biasing the guide portion in a direction of the front panel when the contact of the guide portion therewith is released.

12. An image forming apparatus having a paper-feeding device, the paper-feeding device comprising:

a paper-feeding cassette detachably mounted to a mounting section of a paper-feeding cassette in a body of the image forming apparatus, and including a loading portion with plural sheets of paper and a front panel connected to the loading portion to slide close to/apart from the loading portion;

a pick-up device provided at one side of the mounting section of the paper-feeding cassette to pick up the paper from the loading portion;

a pick-up controller operating in cooperation with a sliding of the front panel with respect to the loading portion when the paper-feeding cassette is mounted and removed and the pick-up controller lowering the pick-up device after the loading portion is mounted to the mounting section and detaching the loading portion from the mounting section after the pick-up device is raised; and a pick-up bracket rotatably connected to a frame that is provided at an upper side of the mounting section and rotating around a rotating shaft, with one end of the pick-up bracket being connected to the pick-up device; and the front panel is connected to the loading portion by a sliding member, and the pick-up controller operating in cooperation with the front panel and lowering the pick-up device after the loading portion is mounted and detaching the loading portion after the pick-up device is raised, wherein the pick-up controller includes:

a bearing portion formed at the other end of the pick-up bracket;

a guide portion provided at the frame parallel with a direction of the rotating shaft to which the pick-up bracket is installed, and having one end thereof contacting the front panel, and reciprocating the direction of in the rotating shaft; and a cam portion provided at the other end of the guide portion to be connected to the bearing portion, and causing the pick-up bracket to perform a seesaw operation in cooperation with an operation of the front panel to raise and lower the pick-up device.

13. The image forming apparatus of claim 12, wherein the front panel includes:

a handling portion provided at a front portion of the front panel and used when the paper-feeding cassette is mounted and removed; and a connecting member sliding toward the loading portion, and connected to the handling portion so that the front panel is mounted and removed to and from the front portion of the loading portion in cooperation with the handling portion.

14. The image forming apparatus of claim 13, wherein the guide portion includes a resilient portion contacting the frame when the guide portion contacts the front panel, and resiliently biasing the guide portion in a direction of the front panel when the contact of the guide portion therewith is released.

15. A paper-feeding device of an image forming apparatus, comprising:

a paper-feeding cassette detachably mounted to the image forming apparatus and including a loading portion to load sheets of paper and a front panel connected to the loading portion to side close to/apart from the loading portion;

a pick-up device arranged to pick up paper from the paper-feeding cassette;

a pick-up bracket with one end of the pick-up bracket being connected to the pick-up device; and a pick-up controller operating in cooperation with a sliding of the front panel with respect with loading portion to lower the pick-up device after loading the paper-feeding cassette and to detach the paper-feeding cassette after the pick-up device is raised, wherein the front panel includes:

a handling portion provided at a front portion of the front panel and used when the paper-feeding cassette is mounted and removed; and a connecting member sliding toward the loading portion, and connected to the handling portion so that the front panel is mounted and removed to and from the front portion of the loading portion in cooperation with the handling portion, and wherein a connecting ring is provided at the loading portion, and the connecting member is connected and suspended from the connecting ring.

16. The paper-feeding device of claim 15, further including:

a mounting section of the paper-feeding cassette in a body of the image-forming apparatus; and a sliding member attached to the paper-feeding cassette.

* * * * *